US011276951B2

(12) United States Patent
Pillard et al.

(10) Patent No.: US 11,276,951 B2
(45) Date of Patent: Mar. 15, 2022

(54) SOCKET-OUTLET EQUIPPED WITH A DISC AND A SHUTTER

(71) Applicant: MARECHAL ELECTRIC, Saint Maurice (FR)

(72) Inventors: Romain Pillard, Chartrettes (FR); Johnny Dos Santos, Garches (FR); Francis J Zagroun, Neuilly-sur-Seine (FR)

(73) Assignee: MARECHAL ELECTRIC, Saint Maurice (FR)

( * ) Notice: Subject to any disclaimer, the term of this patent is extended or adjusted under 35 U.S.C. 154(b) by 0 days.

(21) Appl. No.: 16/961,424

(22) PCT Filed: Jan. 11, 2019

(86) PCT No.: PCT/FR2019/050057
§ 371 (c)(1),
(2) Date: Jul. 10, 2020

(87) PCT Pub. No.: WO2019/138196
PCT Pub. Date: Jul. 18, 2019

(65) Prior Publication Data

US 2020/0358219 A1 Nov. 12, 2020

(30) Foreign Application Priority Data

Jan. 12, 2018 (FR) ..... 1850261

(51) Int. Cl.
*H01R 13/44* (2006.01)
*H01R 13/453* (2006.01)
*H01R 13/642* (2006.01)

(52) U.S. Cl.
CPC ..... *H01R 13/4532* (2013.01); *H01R 13/642* (2013.01)

(58) Field of Classification Search
CPC ..... H01R 13/4532; H01R 13/642; H01R 13/453; H01R 13/447; H01R 13/44; H01R 13/443; H01R 13/64
(Continued)

(56) References Cited

U.S. PATENT DOCUMENTS 4,176,898 A * 12/1979 Marechal ..... H01R 13/447 439/139
4,203,640 A * 5/1980 Bice ..... H01R 13/4532 439/139

(Continued)

FOREIGN PATENT DOCUMENTS

EP 0528735 A1 2/1993

OTHER PUBLICATIONS

International Search Report and Written Opinion from PCT Application No. PCT/FR2019/050057, dated Apr. 9, 2019.

(Continued)

*Primary Examiner* — Harshad G Patel
(74) *Attorney, Agent, or Firm* — Workman Nydegger

(57) ABSTRACT

A socket-outlet comprising a fixed element, a disc having through holes for passing the pins of a plug, the disc being rotationally movable about the axial direction with respect to the fixed element between a protection position and a connection position, and a shutter rotationally movable about the axial direction with respect to the fixed element and with respect to the disc between a closing position wherein the shutter closes at least one hole of the disc when the disc is in the protection position and an open position wherein the shutter opens up the at least one hole when the disc is in the connection position.

11 Claims, 11 Drawing Sheets

(58) Field of Classification Search
USPC ..... 439/139
See application file for complete search history.

(56) References Cited

U.S. PATENT DOCUMENTS 4,339,165 A * 7/1982 Malsot ..... G02B 6/3816 439/139
4,520,243 A * 5/1985 McIntyre ..... H01R 13/71 200/51.07
4,902,238 A * 2/1990 Iacobucci ..... H01R 13/447 439/135
5,234,350 A 8/1993 Marechal et al.
5,286,213 A * 2/1994 Altergott ..... H01R 13/4532 200/51.09
5,564,934 A * 10/1996 Shimotsu ..... G02B 6/3849 439/139
5,685,727 A * 11/1997 Cairns ..... G02B 6/3816 439/139
5,697,798 A * 12/1997 Marechal ..... H01R 13/4532 439/139
9,905,969 B1 * 2/2018 Baldwin ..... H01R 13/639
10,170,872 B1 * 1/2019 Baldwin ..... H01R 13/639
10,559,916 B1 * 2/2020 Lo ..... H01R 13/5219
10,581,212 B2 * 3/2020 Harte ..... H01R 33/22
2010/0323542 A1 * 12/2010 Boucher ..... H01R 13/4532 439/137
2015/0162691 A1 * 6/2015 Choiselat ..... H01R 13/4532 439/139

OTHER PUBLICATIONS

Search Report from corresponding French Application No. 1850261, dated Aug. 24, 2018.

* cited by examiner

SOCKET-OUTLET EQUIPPED WITH A DISC AND A SHUTTER

TECHNICAL FIELD

The present disclosure relates to a socket-outlet, particularly, but not only, an end contact socket-outlet.

A socket-outlet forms a female portion that may belong to a power connection (where the socket-outlet is generally secured to a wall, a casing or the equivalent), to an extension cord, or to a connector (where the socket-outlet generally forms part of a socket), while a plug forms a male portion that may belong to a power connection (where the plug generally forms part of the movable connection), to an extension cord, or to a connector (where the plug is generally secured to an appliance or the equivalent).

In general manner, a socket comprises a socket-outlet and a handle or cap secured to said socket-outlet; a movable connection comprises a plug and a handle or cap secured to said plug; an extension cord is an assembly comprising a socket and a movable connection; a power connection is an assembly comprising a socket-outlet and a plug; and a connector is an assembly comprising a socket and a plug. The handle or cap may be incorporated with the socket-outlet or with the plug, in which circumstance said socket-outlet or plug also forms a socket or a movable connection.

TECHNICAL BACKGROUND

Socket-outlets are known comprising a disc having holes for passing the pins of a plug in order to electrically connect a plug with contacts of the socket-outlet, the disc being rotationally movable about the axial direction with respect to the casing between a protection position wherein the holes are not aligned along the axial direction with the corresponding contacts and a connection position wherein each hole is aligned along the axial direction with a corresponding contact. However, in some configurations, foreign bodies can enter the socket-outlet via the holes of the disc, particularly in the protection position. Such foreign bodies are particularly harmful to the correct operation of the socket-outlet, and can in particular promote the appearance of damaging or uncontrolled electrical arcs upon the connection/disconnection of the socket-outlet to/from the plug. Moreover, in some extreme configurations and malicious uses, tools may be inserted into the socket-outlet, which is of course to be avoided in terms of safety. A need therefore exists in this area.

INTRODUCTION

The present disclosure relates to a socket-outlet.

An embodiment relates to an socket-outlet extending along an axial direction and along a circumferential direction, comprising a fixed element, a disc having through holes for passing the pins of a plug in order to electrically connect a plug to contacts of the socket-outlet, the disc being rotationally movable about the axial direction with respect to the fixed element between a protection position wherein the holes are not aligned along the axial direction with the corresponding contacts and a connection position wherein each hole is aligned along the axial direction with a corresponding contact, and a shutter rotationally movable about the axial direction with respect to the fixed element and with respect to the disc between a closing position wherein the shutter closes at least one hole of the disc when the disc is in the protection position and an open position wherein the shutter opens up the at least one hole when the disc is in the connection position.

Of course, the fixed element is fixed in relation to the disc and the shutter.

It will be understood that the circumferential (or azimuthal) direction is a direction describing a ring about the axial direction. This direction corresponds to the relative direction of rotation of the disc and the shutter with respect to the fixed element.

For example, the socket-outlet (and therefore the complementary plug) is of the "end contact" type. An "end"-type contact is a contact where the electrical connection with a pin is provided by a contact face substantially perpendicular to the axial direction. Such a contact is configured to cooperate in abutment with a complementary face, for example a distal end face of a pin, the contact between these two faces being generally made with a certain pressure to guarantee the passing of current from one contact to the other.

The disc has a plurality of holes for passing the pins of a plug complementary to the socket-outlet. For example, to electrically connect the socket-outlet and the plug, the pins of the socket-outlet are at least partly inserted into the holes of the disc, the disc being in the protection position, the disc is pivoted via the pins by relatively turning the socket-outlet with respect to the plug about the axial direction in such a way as to bring the disc into the connection position from the protection position, and the pins are then inserted all the way into the holes of the disc, in such a way as to make an electrical connection between the pins of the plug and the contacts of the socket-outlet. In general, it will be understood that the disc is in the protection position when the socket-outlet is not in engagement with the plug whereas the disc is in the connection position when the socket-outlet is electrically connected to the plug.

The disc is movable between the protection position and the connection position. The shutter is movable between the closing position and the open position. The shutter takes the closing position at least when the disc is in the protection position and the open position at least when the disc is in the connection position. In other words, the shutter can take one or the other of these two positions, or an intermediate position between these two positions when the disc is in an intermediate position between the protection position and the connection position.

The shutter is configured to close at least one hole of the disc in the closing position. For example, the disc has a plurality of holes distributed along the circumferential direction (i.e. peripheral holes), the shutter being configured to close all the peripheral holes. For example, the disc can have a central hole, this central hole remaining open whatever the position of the shutter (in other words, the shutter is not configured to close the central hole).

Owing to the shutter, a certain number of the holes of the disc are closed in the protection position, such that any foreign bodies are blocked outside the socket-outlet. In other words the risks of intrusion of a foreign body into the socket-outlet are minimized. This reduces the risk of damaging or uncontrolled electrical arcs appearing upon the connection/disconnection of the socket-outlet to/from a plug. Such a shutter also makes it possible to block any deliberate attempt to insert a tool or other outside element into the socket-outlet.

In some embodiments, the angular stroke of the disc between the protection position and the connection position is different from the angular stroke of the shutter between the closing position and the open position.

Such a configuration makes it possible to provide a different amplitude of rotation between the disc and the shutter, owing to which covers or passages of the shutter may easily be positioned in front of the holes of the disc as a function of the angular position of the disc and the shutter. For example, provision can be made for a sequencing of the movements between the disc and the shutter. It is possible to avoid mechanical contacts and friction between the shutter and the pins of the plug and avoid the creation of foreign bodies within the socket-outlet. Owing to this configuration, the closing of the holes is thereby made easier, which further reduces the risk of intrusion of foreign bodies and of formation of damaging or uncontrolled electrical arcs.

In some embodiments, the angular stroke of the shutter between the closing position and the open position is less than the angular stroke of the disc between the protection position and the connection position.

Such a configuration makes it possible to easily make the shutter pass from the closing position to the open position, and conversely, when the disc passes from the protection position to the connection position, and conversely. The closing of the holes is thereby made easier, which further reduces the risk of intrusion of foreign bodies and formation of damaging or uncontrolled electrical arcs. Moreover, such a configuration makes it possible to reduce the total bulk of the shutter to pass from the closing position to the open position.

In some embodiments, the disc is rotationally coupled with the shutter over a predetermined angular stroke less than the total angular stroke of the disc between the protection position and the connection position.

This makes it possible to automatically drive the shutter from the closing position to the open position, and conversely, when the disc passes from the protection position to the connection position, and conversely. The closing of the holes is thereby made easier, which further reduces the risk of intrusion of foreign bodies and formation of damaging or uncontrolled electrical arcs.

In some embodiments, one element from among the shutter and the disc has a first lug configured to abut along the circumferential direction in a first direction against a first shoulder of the other element from among the shutter and the disc and in a second direction, opposite the first direction, against a second shoulder of the other element from among the shutter and the disc (the first shoulder and the second shoulder being face-to-face along the circumferential direction), the difference between the total angular stroke of the disc between the protection position and the connection position and the predetermined angular stroke being equal to the maximum angular stroke of the first lug between the first shoulder and the second shoulder.

It will be understood that if the shutter has the first lug, then the disc has the first and second shoulders, and that conversely if the shutter has the first and second shoulders, then the disc has the first lug.

The circumferential stroke of the first lug is therefore limited by the first shoulder and by the second shoulder. In other words, the circumferential stroke of the first lug is limited in the first direction by the first shoulder whereas the circumferential stroke of the first lug in the second direction is limited by the second shoulder.

Such a configuration allows a certain freedom of rotation of the shutter with respect to the disc (and conversely). For example, this angular stroke allows the shutter to pass from the closing position to the open position and conversely. It will be understood that the sum of the free angular stroke between the disc and the shutter and of the predetermined angular stroke is equal to the angular stroke of the disc between the protection position and the connection position.

Such a coupling structure is simple and reliable, and allows the easy assembly of these elements while providing certain robustness in use, which makes it possible to provide in the long term a reduced risk of intrusion of foreign bodies into the socket-outlet and formation of damaging or uncontrolled electrical arcs.

In some embodiments, an element from among the shutter and the fixed element has a second lug configured to abut along the circumferential direction in a first direction against a third shoulder of the other element from among the shutter and the fixed element and in a second direction, opposite the first direction, against a fourth shoulder of the other element from among the shutter and the fixed element (the third shoulder and the fourth shoulder being face-to-face along the circumferential direction), the predetermined angular stroke being equal to the maximum angular stroke of the second lug between the third shoulder and the fourth shoulder.

It will be understood that if the shutter has the second lug, then the fixed element has the third and fourth shoulders, and that conversely if the shutter has the third and fourth shoulders, then the fixed element has the second lug.

The circumferential stroke of the second lug is therefore limited by the third shoulder and by the fourth shoulder. In other words, the circumferential stroke of the second lug is limited in the first direction by the third shoulder whereas the circumferential stroke of the second lug in the second direction is limited by the fourth shoulder.

Such a configuration allows a certain freedom of rotation of the shutter with respect to the fixed element. For example, this angular stroke allows the disc to reach, when the disc is rotationally coupled with the shutter in one direction or the other along the circumferential direction, the protection position or the connection position. It will therefore be understood that this angular stroke between the shutter and the free element corresponds to the predetermined angular stroke.

Such a coupling structure is simple and reliable, and allows the easy assembly of these elements while providing certain robustness in use, which makes it possible to provide in the long term a reduced risk of intrusion of foreign bodies into the socket-outlet and formation of damaging or uncontrolled electrical arcs.

In some embodiments, the shutter is rotationally blocked between the fixed element and the disc when the disc is in the protection position.

For example, the first lug is blocked in the first circumferential direction by the first shoulder whereas the second lug is blocked in the second circumferential direction by the fourth shoulder, or conversely the first lug is blocked in the second circumferential direction by the second shoulder whereas the second lug is blocked in the first circumferential direction by the third shoulder.

Such a configuration makes it possible to ensure that the shutter stays in the closing position when the disc is in the protection position. The closing of the holes is thereby made easier, which further reduces the risk of intrusion of foreign bodies and formation of damaging or uncontrolled electrical arcs.

In some embodiments, the shutter is rotationally blocked between the fixed element and the disc when the disc is in the connection position.

For example, the first lug is blocked in the second circumferential direction by the second shoulder whereas the second lug is blocked in the first circumferential direction by the third shoulder, or conversely the first lug is blocked in the first circumferential direction by the first shoulder whereas the second lug is blocked in the second circumferential direction by the fourth shoulder.

Such a configuration makes it possible to ensure that the shutter stays in the open position when the disc is in the connection position. This makes it possible to reduce the risk of mechanical interference between the shutter and the socket-outlets of the connector when the plug is electrically connected to the socket-outlet, interference which could degrade the shutter and over time disrupt the electrical connection with the debris of the shutter. This improves the reliability of the shutter, and thus reduces over the long term the risk of intrusion of foreign bodies and formation of damaging and uncontrolled electrical arcs.

In some embodiments, the disc and the shutter are adjacent, the disc having an outer face, oriented toward the outside of the socket-outlet, and an inner face, oriented toward the inside of the socket-outlet and opposite along the axial direction to the outer face, the shutter being disposed on the side of the inner face of the disc with respect to the disc.

In other words, the shutter is inside the socket-outlet whereas the disc forms an outer face of the socket-outlet. In other words, considered along the axial direction, the disc is disposed on the side of the socket-outlet intended to cooperate with the plug with respect to the shutter.

In such a configuration, the disc protects all the elements disposed inside the socket-outlet, including the shutter, whereas the shutter closes the holes of the disc from inside the socket-outlet. This makes it possible to improve the robustness and the reliability of the shutter in the long term, the latter being protected by the disc, whereas the disc is configured, in general, to protect the inside of the socket-outlet from outside aggressions. This improves the reliability of the shutter, and thus reduces over the long term the risk of intrusion of foreign bodies and formation of damaging and uncontrolled electrical arcs.

In some embodiments, the shutter has a general star shape comprising a central part and a plurality of branches extending radially from the central part, at least one branch of the star being configured to close at least one hole of the disc when the shutter is in the closing position and when the disc is in the protection position.

For example, each branch of the shutter is configured to close one hole of the disc when the shutter is in the closing position and when the disc is in the protection position. For example the disc has a plurality of holes distributed along the circumferential direction (i.e. peripheral holes), the shutter being configured to close all the peripheral holes, each branch closing one peripheral hole of the disc.

Such a configuration of the shutter makes it possible to easily close/open up the holes of the disc owing to the branches, and to do so in a particularly reliable and repeatable way. This improves the reliability of the shutter, and thus reduces over the long term the risk of intrusion of foreign bodies and formation of damaging and uncontrolled electrical arcs.

In some embodiments, the socket comprises a movable element bearing several contacts, the movable element being movable axially between a first position and a second position, the movable element being nearer to the disc along the axial direction in the first position than in the second position.

For example, the first position is a contact position wherein the movable element is configured to come into contact (i.e. the contacts borne by the movable element come into contact) with the pins of a plug whereas the second position is configured to be remote (i.e. the contacts borne by the movable element are remote) from the pins of the plug.

The disc and shutter structure according to the present disclosure is particularly well-suited to socket-outlets comprising such a movable element. Specifically, sockets comprising such a movable element generally have a main recess receiving the movable element. Thus, whatever the position of the disc, the holes of the disc open freely into the main recess wherein are housed the movable element and the contacts borne by the movable element. It is therefore particularly advantageous to close the holes of the disc in such a context.

In some embodiments, the contacts borne by the movable element are spaced apart along the circumferential direction and, considered along the circumferential direction, when the movable element is in the first position, each contact is disposed between two adjacent branches of the star shape of the shutter.

In other words, in the first position the contacts of the movable element and the branches of the shutter are not aligned along the axial direction. This ensures that in the first position of the movable element the shutter is prevented from accessing the contact, owing to which one is sure not to alter the shutter with the pins of the plug when the connection is made between the contacts of the socket-outlet and the pins of the plug. This improves the reliability of the shutter, and thus reduces over the long term the risk of intrusion of foreign bodies and formation of damaging and uncontrolled electrical arcs.

The present disclosure also relates to an assembly comprising a socket-outlet as claimed in any one of the embodiments described in the present disclosure and a plug.

BRIEF DESCRIPTION OF THE DRAWINGS

The subject of the present disclosure and its advantages will be better understood on reading the detailed description below of different embodiments given by way of non-limiting examples. This description refers to the appended pages of figures, wherein.

DETAILED DESCRIPTION

Figure 1:
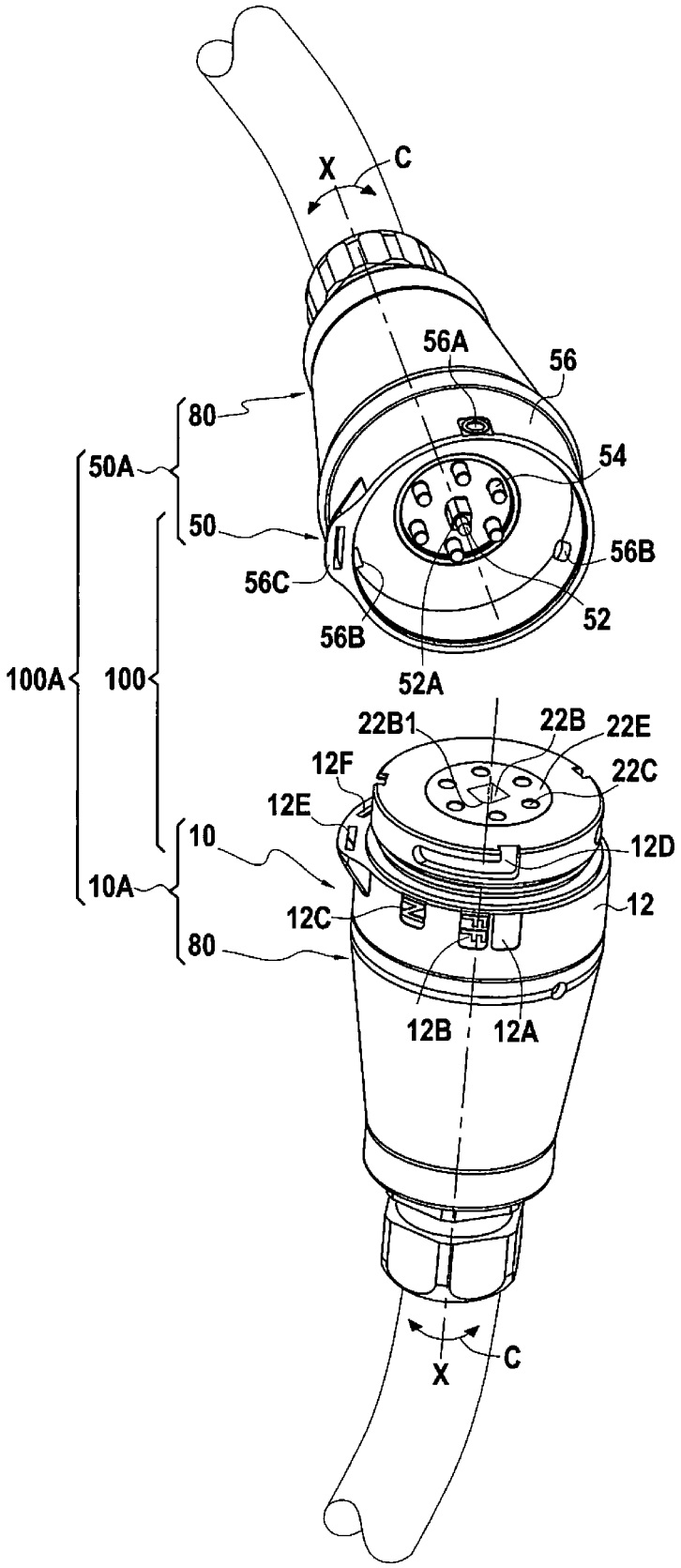
FIG. 1 shows an assembly comprising a socket-outlet and a plug, separate.

FIG. 1 shows an assembly 100 according to a first embodiment comprising a socket-outlet 10, and a plug 50. The socket-outlet 10 and the plug 50 each extend along an axial direction X and a circumferential direction C. The axial direction X corresponding to the direction of socketing (or engagement) of the socket-outlet 10 and of the plug 50. The socket-outlet 10 and the plug 50 have in this example an annular structure of axis X (the axis X defining in this example the axial direction X). In FIG. 1, the socket-outlet 10 and the plug 50 are detached and are therefore not engaged, such that the axial directions X of each of the sockets are not colinear, but these directions are of course colinear when these sockets are cooperating (see for example FIGS. 6A and 6B). In this example, the socket-outlet 10 and the plug 50 are each equipped with a handle 80, thus respectively forming socket 10A and a movable connection 50A, the socket 10A and movable connection 50A assembly forming an extension cord 100A. Of course, this example is not limiting and any other configuration can be envisioned for the assembly 100, and more particularly for the socket-outlet 10 on the one hand and the plug 50 on the other hand.

In this example, the plug 50 comprises a central pin 52 and six peripheral pins 54, whereas the socket-outlet 10 comprises the same number of corresponding holes, namely one central through hole 22B and six peripheral through holes 22C. Of course, this number of pins and holes is not limiting, the assembly 100 being able to comprise more or fewer than seven pins/holes. In this example the central pin 52 is connected to the earth (i.e. ground pin) whereas the peripheral pins 54 are each connected to a different phase (i.e. phase pins). In this example, the socket-outlet 10 and the plug 50 are of end contact type.

The socket-outlet 10 comprises a casing 12 having three position indicators to indicate the relative angular position of the socket-outlet 10 with respect to the plug 50, namely a socketing (or engagement) position indicator 12A, a disconnected position indicator 12B and a connected position indicator 12C. These indicators are respectively formed in this example by a rectangular relief 12A, the writing "FF" in relief 12B and the writing "N" in relief 12C. These indicators 12A, 12B and 12C can of course be of a different color than the color of the casing 12, but do not need to be. According to a variant, these indicators are formed by plain marks, and do not comprise any writing.

The plug 50 comprises a casing 56 having an index 56A to indicate the angular position in relation to the plug 50 with respect to the socket-outlet 10. In this example, the index is formed by the writing "O" in relief 56A. This index 56A can of course be of a different color than the color of the casing 56, but does not need to be. For example, the indicators 12A, 12B and 12C and the index 56 can be of the same color, this color being distinct from the color of the casings 12 and 56. According to a variant, this index is formed by a plain mark, and does not comprise any writing.

Figure 7A:
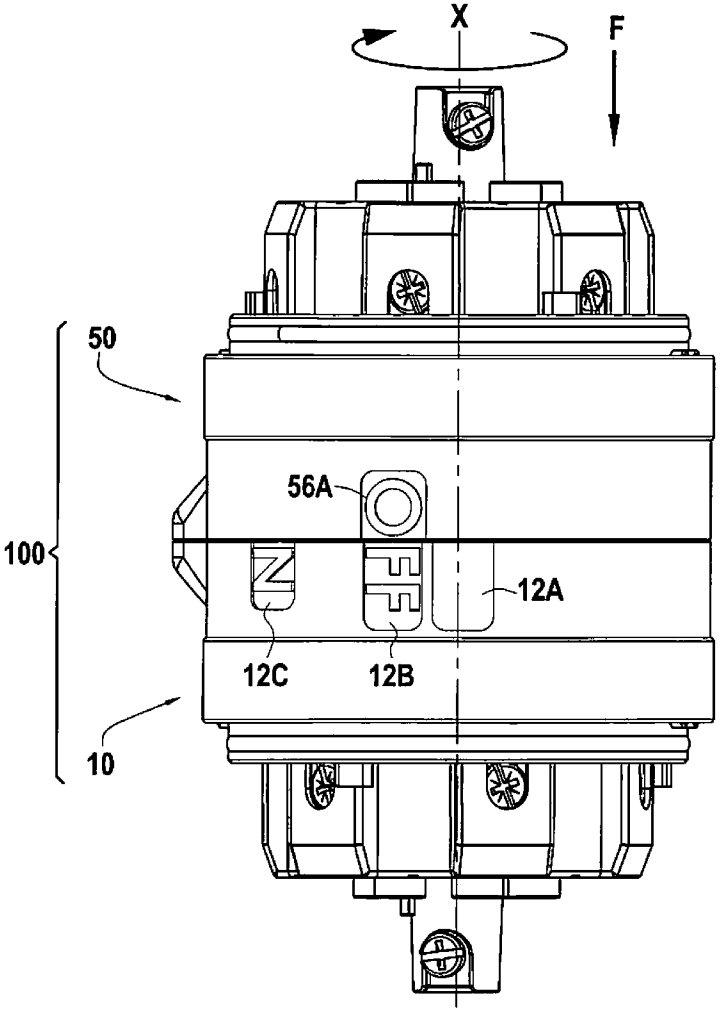
Figure 7C:
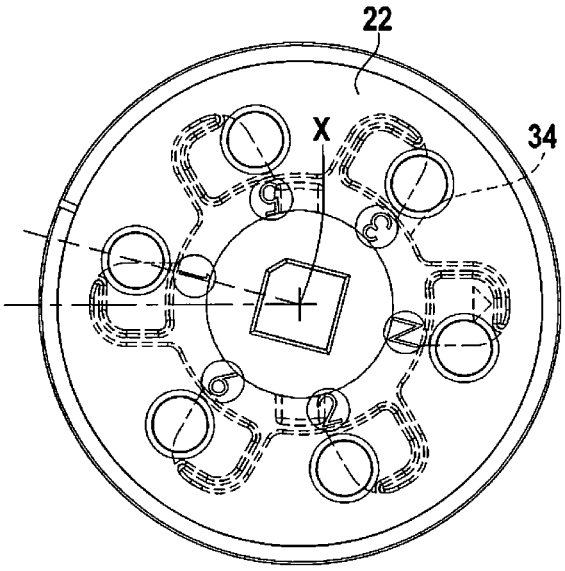
Figure 7D:
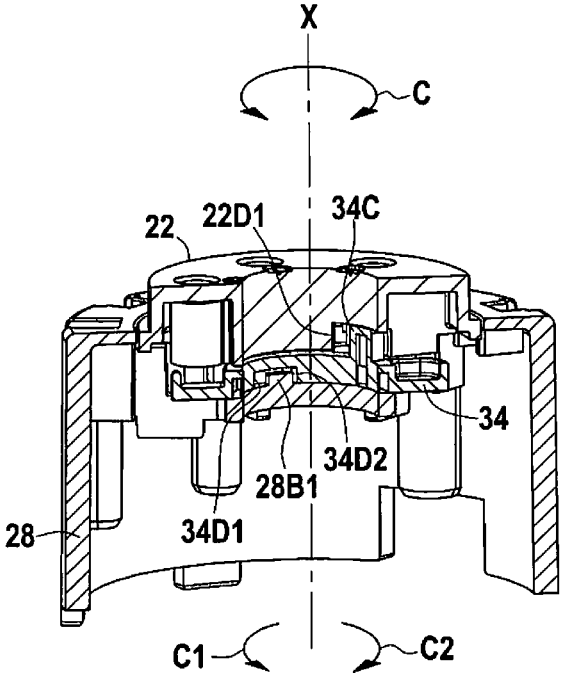
Figure 8B:
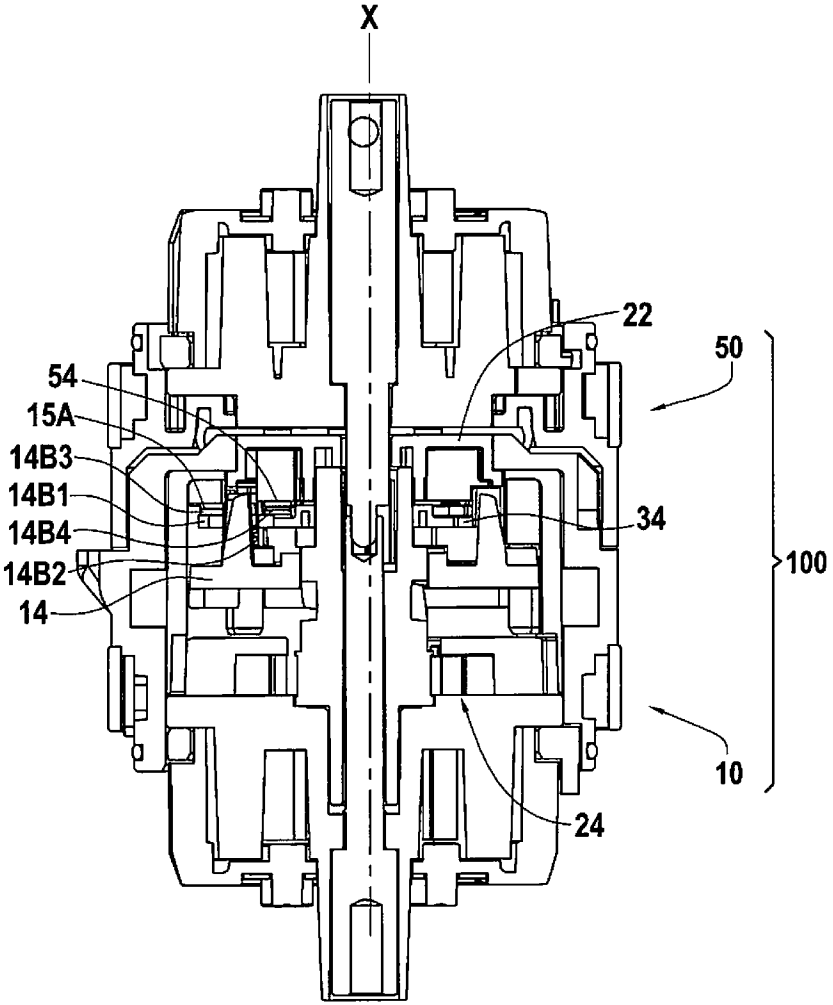
Figure 8A:
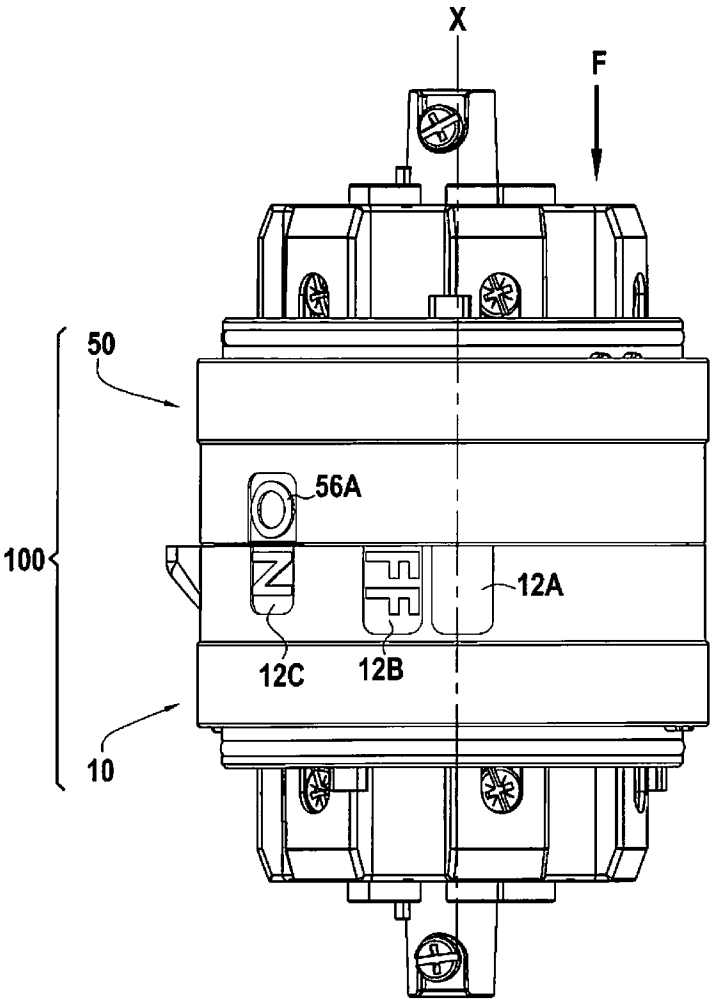

These indicators and indices form a user aid. Thus, to socket or engage the plug 50 with the socket-outlet 10, the index 56A is aligned with the indicator 12A (see FIGS. 5A and 6A). To put the assembly 100 in the disconnected position (position described in more detail below), the sockets 10 and 50 are turned with respect to one another in such a way as to align the index 56A and the indicator 12B (see FIG. 7A). It should be noted that in this configuration, the index 56A and the indicator 12B form the word "OFF" (disconnected). To put the assembly 100 in the connected position (position described in more detail below), the sockets 10 and 50 are turned with respect to one another in such a way as to align the index 56A and the indicator 12C (see FIG. 8A). It should be noted that in this configuration, the index 56A and the indicator 12C form the word "ON" (connected).

Figure 5B:
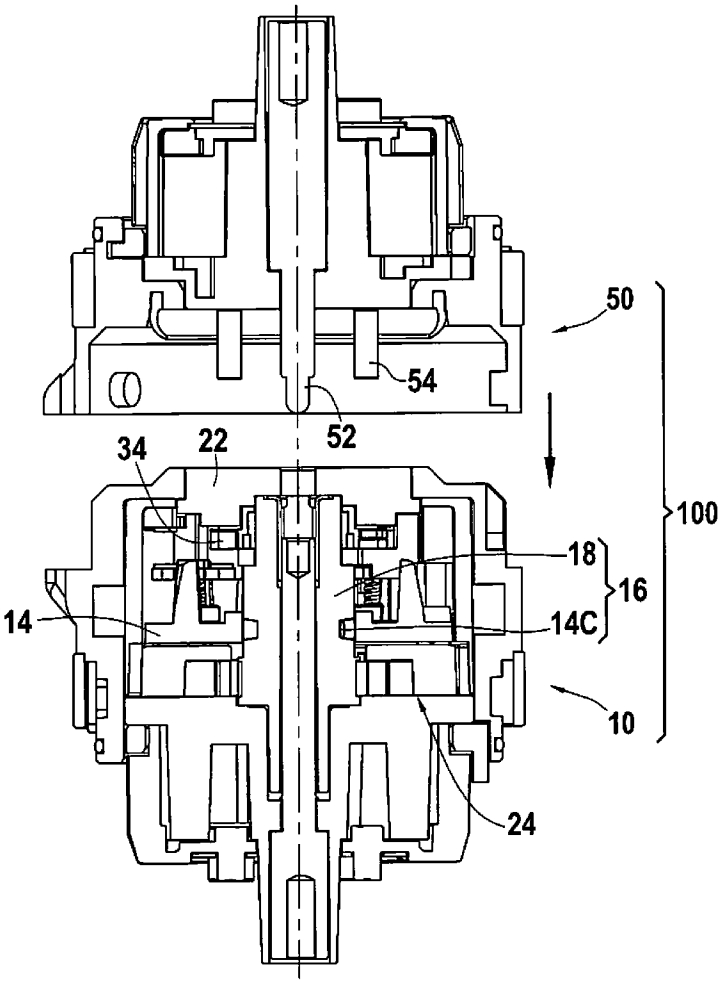
Figure 5A:
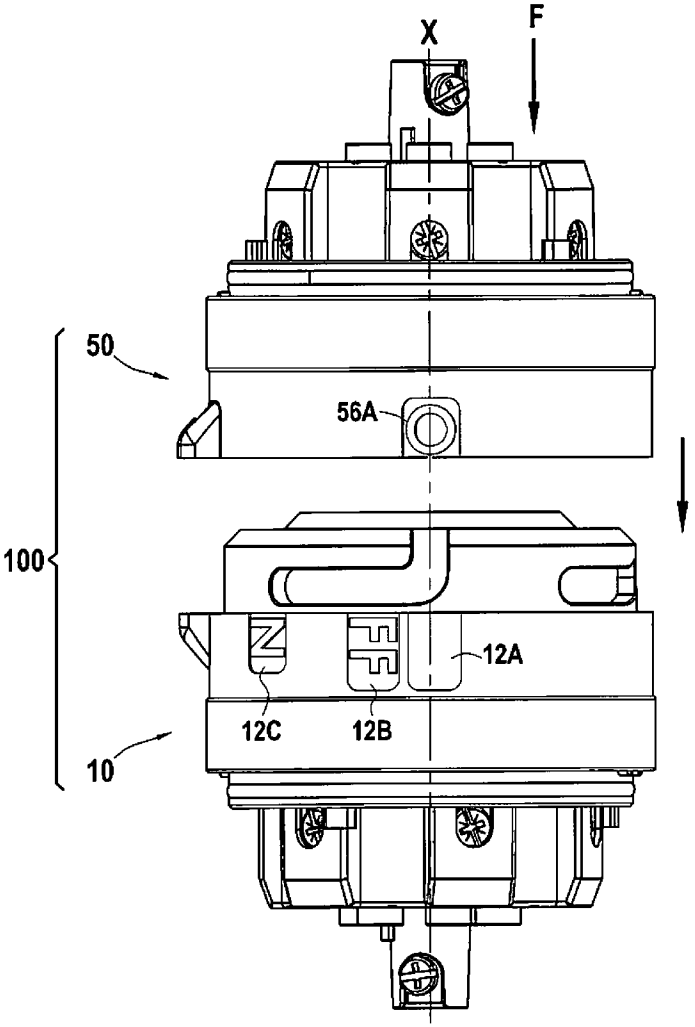
Figure 6B:
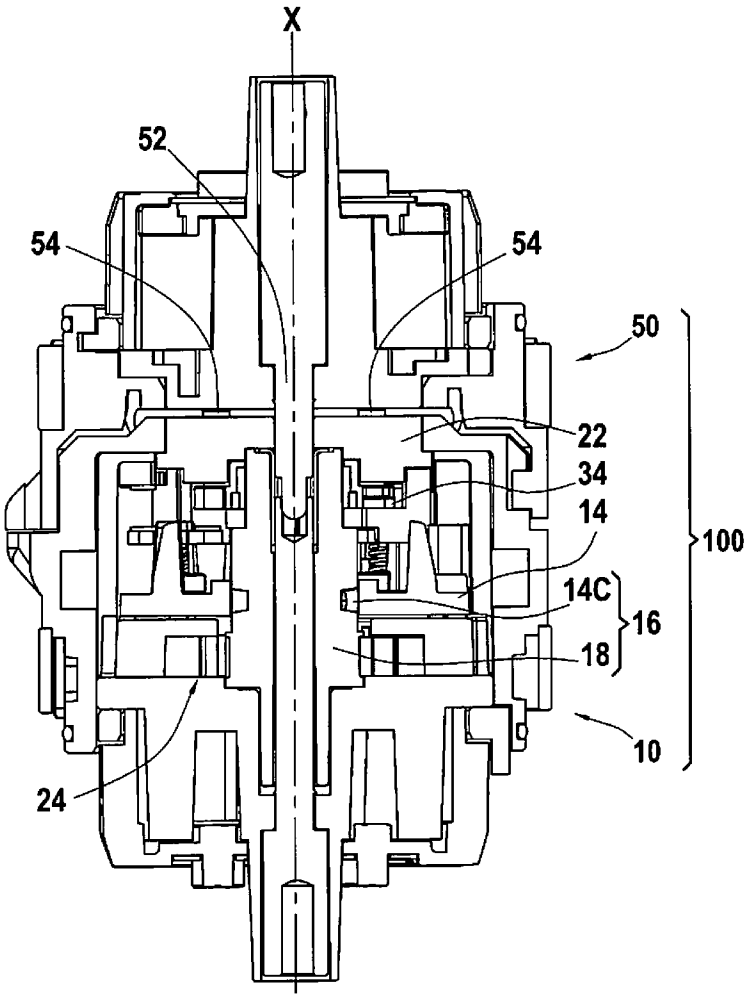
Figure 6A:
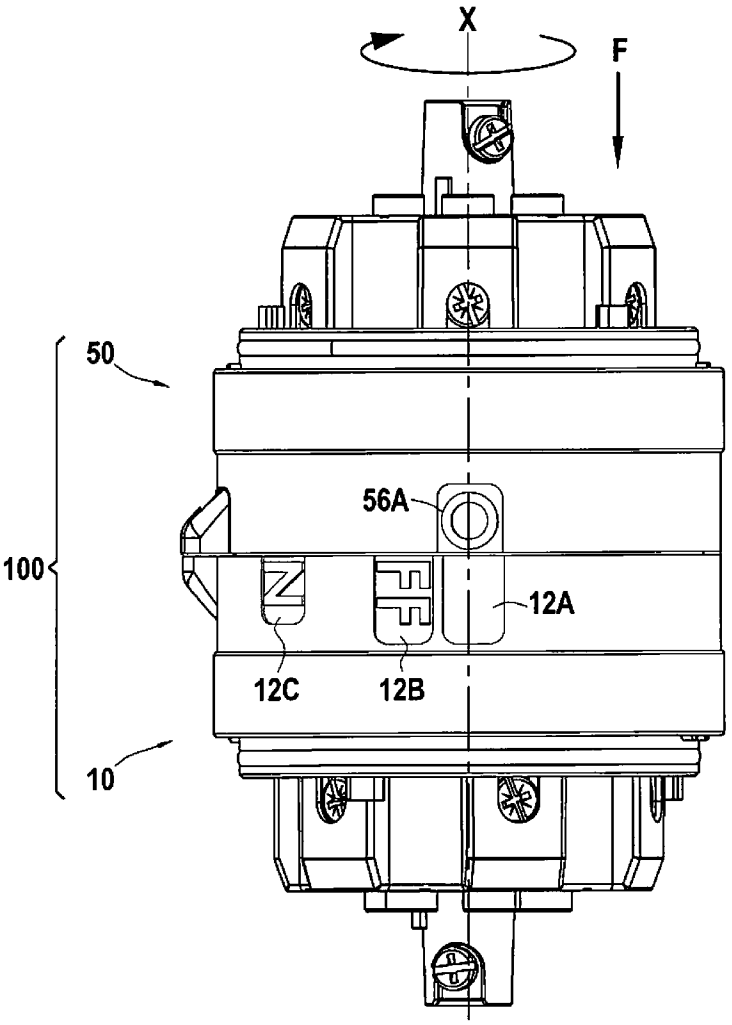
Figure 6C:
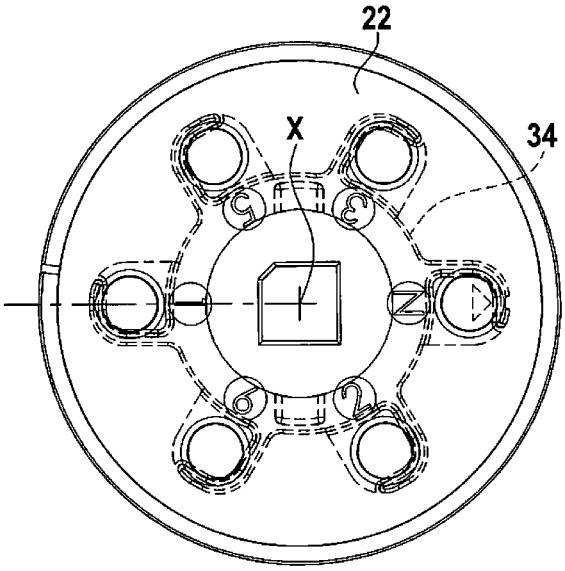
Figure 6D:
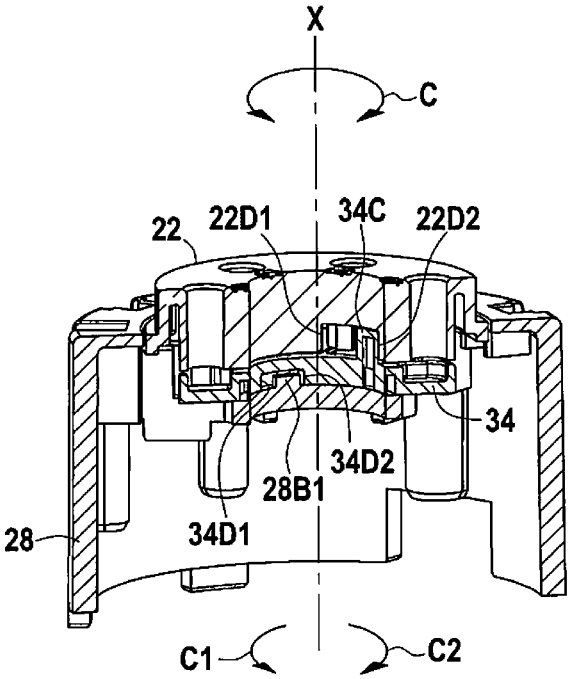

Thus, when the socket-outlet 10 is not engaged with the plug 50, as is shown in FIGS. 1, 5A and 5B, or else when it is only engaged with the plug 50 as is shown in FIGS. 6A and 6B, the socket-outlet 10 is in a so-called socketing configuration. When the sockets are socketed, and the index 56A and the indicator 12B are aligned, the socket-outlet 10 is in a so-called disconnection configuration. When the sockets are socketed, and the index 56A and the indicator 12C are aligned, the socket-outlet 10 is in a so-called connection configuration.

The casing 12 has three grooves 12D configured to each receive a peg 56B of the casing 56. This peg/groove system forms a system for retaining the socket-outlet 10 in engagement with the plug 50. Thus, the pegs 56B can only be engaged/disengaged in/from the groove or grooves 12D in a socketing position, whereas when the sockets are socketed and turned with respect to one another, the pegs 56B are engaged in the grooves 12D such that the plug 50 is retained along the axial direction X with the socket-outlet 10. Such a retaining system makes it possible to avoid any untimely movement along the axial direction X between the socket-outlet 10 and the plug 50, which makes it possible to keep a stable contact and to avoid the formation of damaging or uncontrolled electrical arcs between the pins 54 and the active parts of the socket-outlet 10 described below. In this example, the retaining system comprises three grooves 12D and three pegs 56B but can of course comprise more or fewer than three grooves and pegs.

It should also be noted that the casing 12 has two eyelets 12E and 12F whereas the casing 56 has one eyelet 56C used to lock together the socket-outlet and plug 10 and 50 in the disconnected position (or OFF position) or in the connected position (or ON position), for example using a padlock (not shown).

Figure 2:
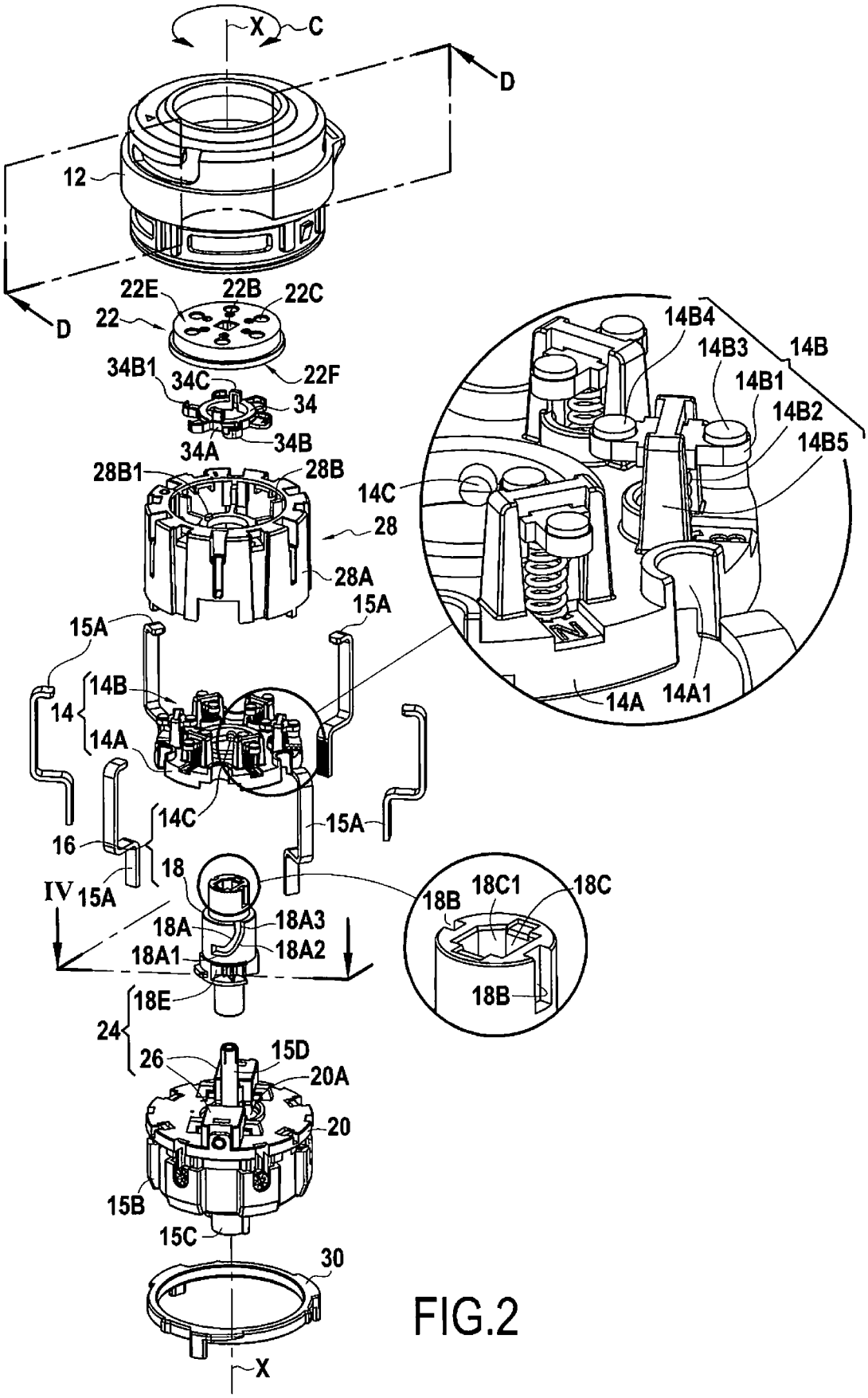
FIG. 2 shows an exploded view of the socket-outlet of FIG. 1.

The socket-outlet 10 and the plug 50 will now be described in more detail with reference to FIGS. 1 and 2. For clarity of disclosure, the wires of the cables shown in FIG. 1 are not shown in FIG. 2.

Figure 7B:
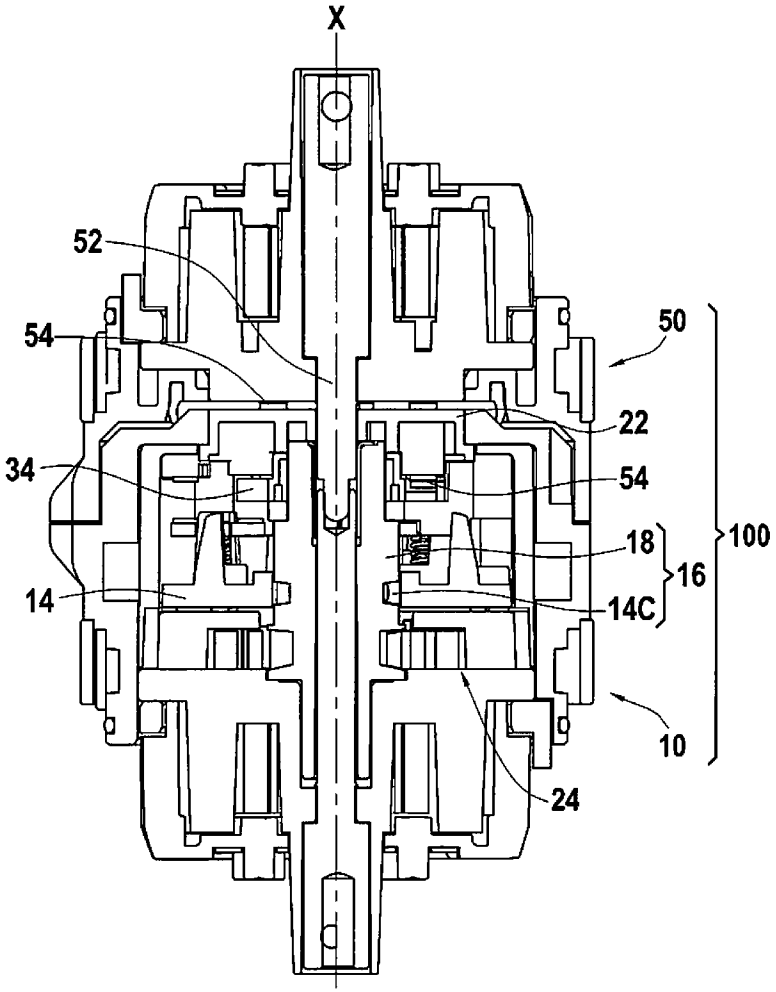

The socket-outlet 10 comprises a movable element 14, which is movable along the axial direction X between a second position or isolated position (see FIGS. 5B, 6B, 7B; socketing configuration and disconnection configuration of the socket-outlet 10) and a first position or contact position (see FIG. 8B; configuration of connection of the socket-outlet 10) owing to a displacement mechanism 16. As will be described in more detail below, the mechanism 16 is configured to displace the movable element 14 from the isolated position toward the contact position and conversely. It should be noted that the movable element 14 is nearer to the disc 22 along the axial direction X in the contact position (first position) than in the isolated position (second position).

The movable element 14 comprises a plate 14A equipped with six distinct portions 14B each configured to contact a peripheral pin 54 of the plug 50. The plate 14A has guiding portions 14A1, in this example axial grooves, configured to cooperate by sliding with non-complementary portions (not shown), in this example axial ribs, of a cage 28 receiving the plate 14A. The cage 28 being assembled in a fixed manner on the base 20 (i.e. immovable with respect to the base), the plate 14A is guided in axial translation in such a way that it does not pivot about the axis X during the passing from the isolated position to the contact position, and conversely. In other words, the plate 14A is rotationally coupled with the cage 28 and the base 20. The cage 28 forms a fixed element within the meaning of the present disclosure.

Each portion 14B comprises a support 14B1 mounted on a spring 14B2 (in this example an axial compression spring) and bearing two contact pads 14B3 and 14B4. The pads 14B3 and 14B4 are in electrical contact, in this example via the support 14B1 which is an electrical conductor. The spring 14B2 makes it possible to exert an axial pressure on the distal end of the corresponding pin 54, to provide a quality end contact. The portion 14B also comprises a guide 14B5 to guide the support 14B1 along the axial direction X and house the spring 14B2. Each portion 14B is mounted on the plate 14A, the six portions 14B being regularly distributed along the circumferential direction on the plate 14A.

In this example, each support 14B1 has an elongated form extending radially with respect to the axis X, the pads 14B3 being disposed radially outward with respect to the pads 14B4. The pads 14B4 are configured to come into contact with the pins 54 of the plug 50 whereas the pads 14B3 are configured to come into contact with contact elements 15A of the socket-outlet 10. Within the meaning of the present disclosure, the portions 14B form contacts of the socket-outlet 10 configured to establish an electrical contact with the plug 50.

The contact elements 15A are bent metal bars, connected to cable clamps 15B on the one hand, and forming a contact shoulder perpendicular to the axial direction X to contact a contact 14B3 on the other hand. These contact elements 15A and the cable clamp 15B form the active parts of the socket-outlet 10. Such a configuration makes it possible to maximize the space, particularly along the circumferential direction, between the portions 14B, and therefore to minimize the risk of formation of damaging or uncontrolled electrical arcs. In this example, the six portions 14B are equidistant and each spaced apart by an angle of 60° about the axis X of the adjacent portion. Thus, the six pads 14B4 are also equidistant and each spaced apart by an angle of 60° about the axis X of the adjacent pad 14B4. In the same way, the pads 14B3 being disposed radially outside the pads 14B3, are also equidistant and each spaced apart by an angle of 60° about the axis X of the adjacent pad 14B3.

Thus in this example, in the isolated position the movable element 14 is in contact neither with the pins 54 of the plug 50, nor with the active parts of the socket-outlet 10. In the contact position, the movable element 14 is in contact on the one hand with the active parts of the socket-outlet 10, and more particularly with the contact elements 15A, and on the other hand with the pins 54 of the plug 50 (see FIG. 8B).

The displacement mechanism 16 comprises a shaft 18 extending axially and comprising a spiral groove 18A as well as a lug 14C belonging to the movable element 14, and more particularly to the plate 14A. The lug 14C is engaged in the spiral groove 18A and cooperates with the spiral groove 18A such that the rotation of the shaft 18 about the axis X drives the lug 14C, and therefore the mobile element 14, in translation along the axial direction X. Of course, the side walls of the spiral groove 18A each form a spiral slope: one cooperating with the lug 14C to displace it in a first direction along the axial direction X, and the other cooperating with the lug 14C to displace it along a second direction, opposite the first direction, along the axial direction X. Of course, those skilled in the art will easily be able to envision other variants comprising only a single spiral slope and for example a spring return system.

The groove 18A has three successive portions 18A1, 18A2 and 18A3. The portion 18A1 extends perpendicular to the axial direction X. The angular extent of this portion 18A1 corresponds to the angular amplitude of the movement necessary to pass from the socketing configuration to the disconnection configuration. This portion being perpendicular to the axial direction, upon this movement the movable element 14 is not displaced along the axial direction X and remains in the isolated position. The portion 18A2 has an inclination of less than 90° with respect to the axial direction X. The angular extent of this portion corresponds to the angular amplitude of the movement needed to pass from the disconnection configuration to the connection configuration. This portion 18A2 being inclined with respect to the axial direction X of an inclination between 0° and 90°, the movable element 14 is axially displaced from the isolated position to the contact position when one passes from the disconnection configuration to the connection configuration. Conversely, the movable element 14 is axially displaced from the contact position toward the isolated position when passing from the connection configuration to the disconnection configuration. This portion 18A2 extends over 50° of angle about the axis X. Thus, the relative angular stroke between the socket-outlet 10 and the plug 50 to displace the movable element 14 between the isolated position and the contact position is less than the minimum angle of 60° separating two adjacent pads 14B4. The portion 18A3 opens along the axial direction X and is parallel to the axial direction X. It essentially serves for the mounting of the socket-outlet 10 and allows the assembly of the movable element 14 with the shaft 18.

The shaft 18 is rotationally mounted on the base 20. More specifically, in this example, the shaft 18 is partly socketed in a bearing 20A fashioned in the base 20.

To be driven in rotation, the shaft 18 is hollow, and has at its distal end opposite the end engaged in the bearing 20A, a recess 18C of square cross section, this square section having a flat 18C1 in one angle, forming a failsafe part. This recess 18C is configured to receive the central pin 52 described below. Within the meaning of the present disclosure, the pin 52 forms an example of a complementary element configured to cooperate by interlocking with the shaft 18.

The shaft 18 bears a disc 22. The disc 22 is rotationally coupled with the shaft 18 by a tenon/mortice system 22A/18B. The disc 22 is borne by the distal end of the shaft 18, opposite the end engaged in the bearing 20A of the base 20. The movable element 14 is disposed between the base 20 and the disc 22. A shutter 34 is disposed between the base 20 and the disc 22. The disc 22 has a central hole 22B and six peripheral holes 22C configured to respectively receive the central pin 52 and the peripheral pins 54 of the plug 50. It should be noted that the central hole 22B has a square general shape having a flat 22B1 in one angle, extending in the continuation of the flat 18C1. Thus the central pin 52A cooperates as much with the shaft 18 as with the disc 22, although the disc 22 is not part of the displacement mechanism 16.

The disc 22 being borne by and rotationally coupled with the shaft 18, it is therefore rotationally movable about the axis X. When the shaft 18 is in a position such that the movable element 14 is in the isolated position, the peripheral holes 22C are not aligned with the pads 14B4 (i.e. the holes 22C and the pads 14B4 have a distinct circumferential position and are not face-to-face along the axial direction X). When the shaft 18 is in a position such that the movable element 14 is in the contact position, the disc 22 permits access to the pads 14B4 of the movable element 14 (i.e. the holes 22C and the pads 14B4 have one and the same circumferential position and are face-to-face along the axial direction X). The disc 22 is then in the connection position.

The disc 22 has two diametrically opposed annular cut-outs 22D (i.e. extending along the circumferential direction C), fashioned in an annular skirt. The circumferential extent of each of these annular cut-outs is limited in a first circumferential direction C1 by a first shoulder 22D1 and in a second circumferential direction C2, opposite the first circumferential direction C1, by a second shoulder 22D2. The disc 22 has an outer face 22E oriented toward the outside of the socket-outlet 10 and an inner face 22F, opposite the outer face 22E along the axial direction X and oriented toward the inside of the socket-outlet 10. The cut-outs 22D are fashioned on the side of the inner face 22F of the disc 22 and are open along the axial direction X on the side of the inner face 22F. Of course, any other configuration making it possible to form the first and second shoulders is can be envisioned.

A shutter 34 is disposed on the side of the inner face 22F of the disc 2 with respect to the disc 22. In this example, the shutter 34 is facing along the axial direction X of the inner face 22F of the disc 22. In other words, the shutter 34 is adjacent to the disc 22 and disposed on the side of the inner face 22F of the disc 22. The shutter 34 is disposed axially between the disc 22 and the cage 28.

The shutter 34 has a general star shape comprising a central part 34A and a plurality of branches 34B, in this example six branches 34B, extending radially from the central part 34A. Each branch 34B is configured to close a peripheral hole 22C of the disc 2. Each branch 34B has a separator 34B1 extending axially. These separators 34B1 serve to prevent the formation of electrical arcs between a first pin 54 and a pad 14B4 configured to come into contact with a second pin 54, adjacent to the first pin. In other words, these separators 34B1 serve to partition the environment around each pin 54.

The central part 34A is annular and is socketed around the shaft 18. The shutter 34, and more particularly in this example the central part 34A, has two diametrically opposed first lugs 34C respectively received in an annular cut-out 22D of the disc 22. In other words, the first lugs 34C project axially toward the disc 22. Thus, each lug 34C can abut in the first circumferential direction C1 against the first shoulder 22D1 of the cut-out 22D that receives it and in the second circumferential direction C2 against the second shoulder 22D2 of the cut-out 22D that receives it. Opposite along the axial direction X of the first lugs 34C, the central part 34A has two diametrically opposed annular cut-outs 34D (i.e. extending along the circumferential direction C), fashioned in an annular skirt. The circumferential extent of each of these annular cut-outs 34D is limited in a first circumferential direction C1 by a third shoulder 34D1 and in a second circumferential direction C2, opposite the first circumferential direction C1, by a fourth shoulder 34D2. In this example the cut-outs 34D are fashioned on the side of the shutter opposite the disc 22 and are open along the axial direction X on the side opposite the disc 22. Of course, any other configuration making it possible to form the third and fourth shoulders can be envisioned.

The cage 28 has a cylindrical portion 28A of axis X configured to guide the plate 14A axially, in particular between the connection position and the isolated position, and a holed portion 28B, transversal to the axial direction X, to allow the passing of the pins 52 and 54. This holed portion 28B has two second lugs 28B1 extending axially toward the shutter 34, these second lugs 28B1 being diametrically opposed. The two second lugs 28B1 are respectively received in an annular cut-out 34D of the shutter 34. Thus, by considering the relative movement between the cage 28 and the shutter 34, the cage 28 being fixed, it is considered that each lug 28B1 can abut in the first circumferential direction C1 against the third shoulder 34D1 of the cut-out 34D which receives it and in the second circumferential direction C2 against the fourth shoulder 34D2 of the cut-out 34D that receives it (or conversely that each third shoulder 34D1 can abut along the second circumferential direction C2 against a second lug 28B1 and that each fourth shoulder 34D2 can abut in the first circumferential direction C1 against a second lug 28B1).

It should be noted that the shutter 34 is driven in rotation by the shaft 18, via the disc 22, upon the cooperation of the first or the second shoulder 22D1 or 22D2 with the first lug 34C whereas the cage 28 limits the angular stroke of the shutter 34, and therefore of the disc 22, via the second lugs 34D. The disc 22 is borne by the shaft 18 whereas the shutter 34 is only socketed around the shaft 18 (without being coupled to the shaft 18) and sandwiched between the cage 18, and more particularly in this example the holed portion 28B of the cage, and the disc 22.

Figure 8C:
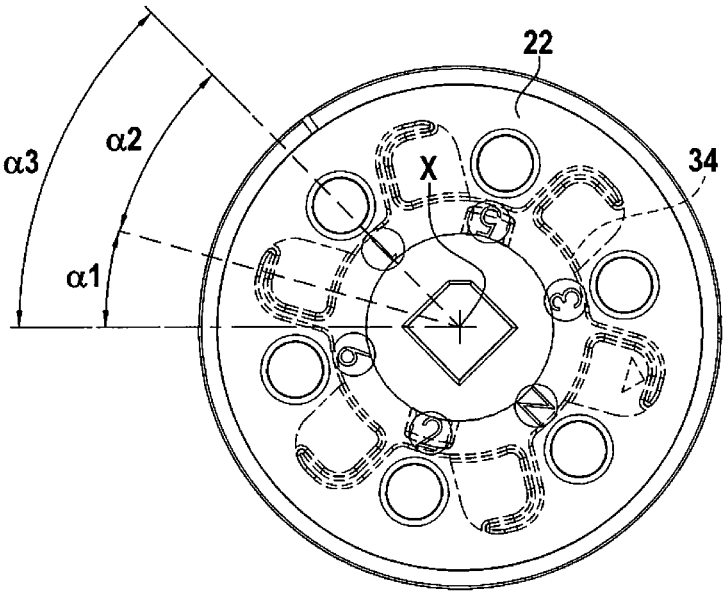

The total angular stroke of the shutter 34 ($\alpha$1 in FIG. 8C) corresponds to the angular stroke of the second lug 28B1 within the angular cut-out 34D between the third and the fourth shoulder 34D1 and 34D2 (or in other words, the cage 28 being fixed, the stroke of the cut-out 34D around the second lug 28B1). The cage 28 being fixed, the shutter 34 travels along this stroke only when it is rotationally coupled with the disc 22, i.e. when the first lug 34C is abutting against the first or the second shoulder 22D1 or 22D2. This stroke forms, within the meaning of the present disclosure, the predetermined angular stroke wherein the disc 22 and the shutter 34 are rotationally coupled. Owing to the circumferential extent of the annular cut-out 22D, the disc 22 can travel an additional angular stroke ($\alpha$2 in FIG. 8C) with respect to the shutter 34 that corresponds to the stroke of the first lug 34C between the first and the second shoulder 22D1 and 22D2. Consequently, the total angular stroke of the disc 22 ($\alpha$3 in FIG. 8C) is equal to the sum of the angular strokes of the shutter 34 with respect to the cage 28 and of the disc 22 with respect to the shutter 34. In other words, the total angular stroke $\alpha$3 of the disc 22 is greater than the predetermined angular stroke $\alpha$1 wherein the disc 22 is rotationally coupled with the shutter 34. In other words, the predetermined angular stroke is less than the total angular stroke of the disc 22.

Figure 5C:
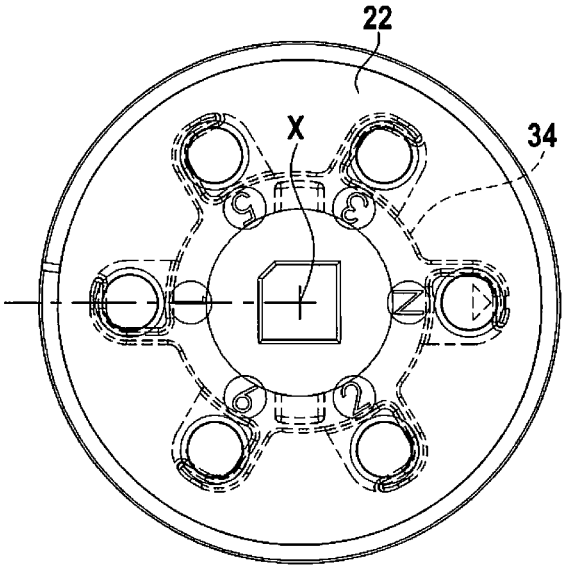
Figure 5D:
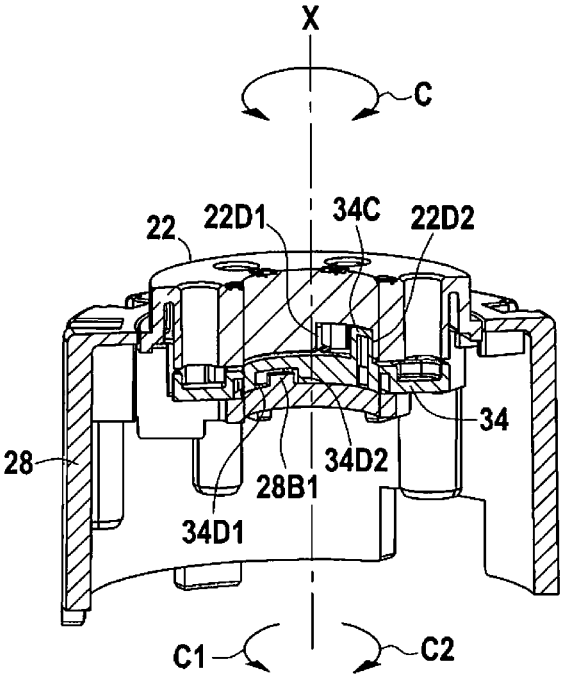

As is visible in FIGS. 5A to 8D, when the first lug 34C is abutting against the second shoulder 22D2, the branches 34B of the shutter 34 close the holes 22C of the disc 22 (see FIGS. 5C and 5D). The shutter 34 is in the closing position. Conversely, when the first lug 34C is abutting against the first shoulder 22D1, the branches 34B of the shutter 34 open up the holes 22C, such that pins 54 can cross the holes 22C. The shutter 34 is in the open position (see FIGS. 8C and 8D). When the first lug 34C is abutting against the first shoulder 22D1 and the second lug 28B1 is abutting against the third shoulder 34D1, then the holes 22C of the disc 22 are aligned along the axial direction with the pads 14B4 (i.e. have the same angular position) such that the pins 54 can come into electrical contact with the pads 14B4 (considered independently of the position of the shutter 34). The disc 22 is in the connection position (see FIGS. 8C and 8D). In this position, the shutter 34 is rotationally blocked in the two circumferential directions C1 and C2 between the cage 28 and the disc 22, by the first shoulder 22D1 and by the second lug 28B1 respectively. When the first lug 34C is abutting against the second shoulder 22D2 and the second lug 28B1 is abutting against the fourth shoulder 34D2, then the holes 22C of the disc 22 are not aligned along the axial direction with the pads 14B4 (i.e. do not have the same angular position) such that the pins 54 cannot come into electrical contact with the pads 14B4 (considered independently of the position of the shutter 34). The disc 22 is in the protection position—see FIGS. 5C, 5D, 6C and 6D). In this position, the shutter 34 is rotationally blocked in both circumferential directions C1 and C2 between the cage 28 and the disc 22, respectively by the second shoulder 22D2 and by the second lug 28B1.

The socket-outlet 10 comprises a retaining device 24 for retaining the movable element 14 in position. This retaining device 24 comprises two cams 18E, similar and disposed at 180° from one another with respect to the centerline of the shaft 18 (i.e. diametrically opposed), and two similar plungers 26 (also diametrically opposed), each plunger element 26 cooperating with a cam 18E. The plunger elements 26 are attached to the base 20 and are therefore immovable with respect to the shaft 18, and therefore with respect to the cams 18E.

Figure 3:
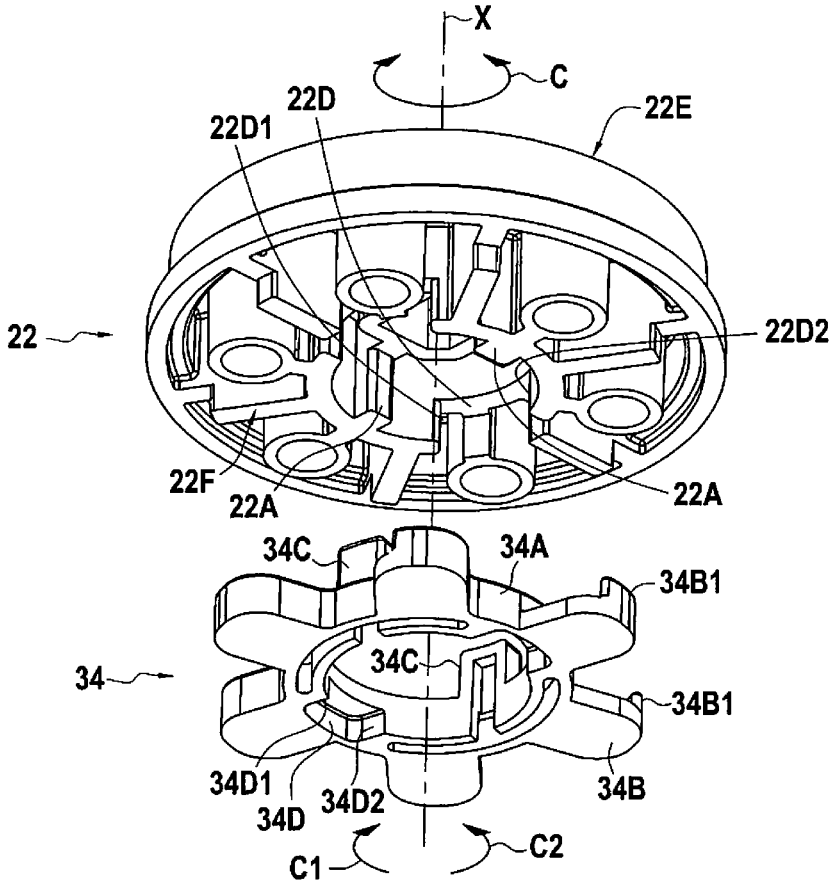
FIG. 3 is a detail view of the disc and the shutter of the socket-outlet of FIG. 1.
Figure 4:
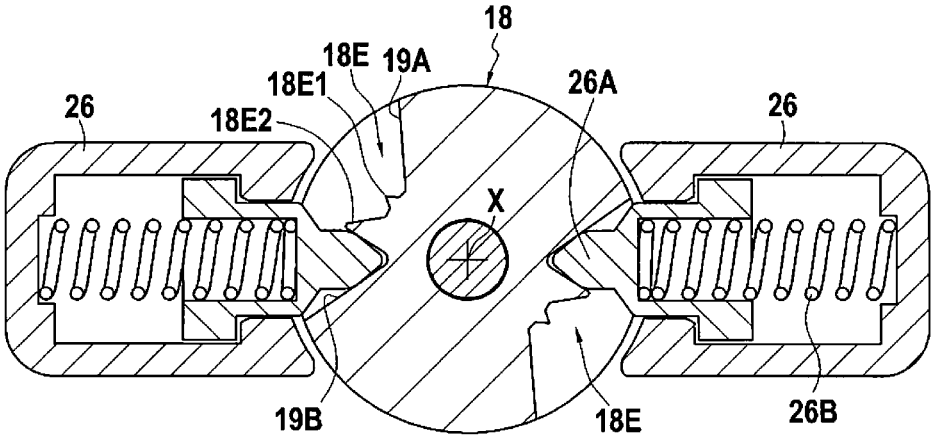
FIG. 4 is a section view along the plane IV of FIG. 2, FIGS. 5A to 5D show the socket-outlet and the plug brought near one another, FIG. 5B being an axial section view of FIG. 5A, FIG. 5C a view along the arrow F of FIG. 5A, and FIG. 5D a section view along the plane D of FIG. 2, FIGS. 6A to 6D show the socket-outlet and the plug in engagement, FIG. 6B being an axial section view of FIG. 6A, FIG. 6C a view along the arrow F of FIG. 6A, and FIG. 6D a section view along the plane D of FIG. 2, FIGS. 7A to 7D show the socket-outlet and the plug in the disconnected position, FIG. 7B being an axial section view of FIG. 7A, FIG. 7C a view along the arrow F of FIG. 7A, and FIG. 7D a section view along the plane D of FIG. 2, and FIGS. 8A to 8D show the socket-outlet and the plug in the connected position, FIG. 8B being an axial section view of FIG. 8A, FIG. 8C a view along the arrow F of FIG. 8A, and FIG. 8D a section view along the plane D of FIG. 2.

The cams 18E and the plungers 26 are described in more detail with reference to FIG. 3. The two cams and the two plungers being identical, a single cam/plunger pair is described. Of course, the present example comprises two cam/plunger pairs, but could comprise only one, or more than two.

The cam 18E extends circumferentially between two stops 19A and 19B and has two teeth 18E1 and 18E2. The plunger element 26 has a needle 26A mounted on a spring 26B which radially presses the needle 26A against the cam 18E. The needle 26A, and more generally the plunger element 26, cooperates by interlocking with the cam 18E. Thus, the plunger element 26 offers a certain resistance when one wishes to turn the shaft 18, this resistance resulting from the passage of the needle 26A over the teeth 18E1 or 18E2. The first tooth 18E1 is smaller than the second tooth 18E2, such that the resistance offered to pass the first tooth 18E1 is less than the resistance offered to pass the second tooth 18E2.

When the needle 26A is disposed between the stop 19A and the first tooth 18E1, the socket-outlet 10 is in the socketing configuration, the movable element 14 being in the isolated position (the lug 14C being disposed in the part 18A1 of the spiral groove 18A). When the needle 26A is between the first tooth 18E1 and the second tooth 18E2, the socket-outlet 10 is in the disconnection configuration, the movable element 14 being in the isolated position (the lug 14C being disposed in the part 18A1 of the spiral groove 18A, in the vicinity of the inclined part 18A2). When the needle 26B is disposed between the second tooth 18E2 and the stop 19B, the socket-outlet 10 is in the connection configuration, the movable element 14 being in the contact position (the lug 14C being in the part 18A2 of the spiral groove 18A).

Thus, owing to the teeth 18E1 and 18E2 and the plunger element 26, only the configurations taken by the socket-outlet 10 when the needle 26A is between the stop 19A and the first tooth 18E1, between the first and second teeth 18E1 and 18E2 and between the second tooth 18E2 and the stop 19B are stable configurations. All the configurations taken by the socket-outlet 10 when the needle is cooperating with one side or the tip of a tooth 18E1 or 18E2 are unstable configurations. Specifically, in this latter case the plunger element 26 exerts a radial pressure tending to turn the cam 18E about the axis X in such a way as to return to a stable position where the plunger element 26 is between two teeth or between a tooth and a stop. Of course, those skilled in the art can use any other known system also making it possible to obtain a similar stability of the different configurations, namely at least one first stable configuration wherein the movable element is in the contact position (i.e. stable connection configuration), one second stable configuration wherein the movable element is in the isolated position (i.e. stable disconnection configuration) and a plurality of unstable intermediate configurations between the first configuration and the second configuration wherein the socket-outlet tends to come into the first configuration or into the second configuration.

It will therefore be understood that the plunger element 26 retains the shaft 18 in position such that the needle 26A is disposed between two teeth or between a tooth and a stop, and opposes the movements tending to move the needle away from these positions. By retaining the shaft 18 in predetermined positions (i.e. angular position where the needle 26A is disposed between two teeth or between a tooth and a stop), the cam 18E and the plunger element 26 make it possible to retain the movable element 14 either in the contact position, or in the isolated position. It should be noted that the passage of the second tooth 18E2 requires a deliberate displacement on the behalf of the user to arrive at the tip of the second tooth 18E2. Beyond this tip, the plunger element 26 assists the user and the end of the movement is done automatically. The speed of rotation of the shaft, and therefore the speed of displacement along the axial direction of the movable element 14, is a function, in this second phase, of the pressure exerted by the plunger element 26 on the cam 18. It is thus possible to control this speed, and therefore the formation of electrical arcs during the connection/disconnection of the pads 14B4 to/from the pins 54.

Moreover, the first tooth 18E1 makes it possible to put up a certain resistance when passing from the socketing configuration to the disconnection position, and conversely. This offers a certain amount of safety for the user. Specifically, when the sockets are mounted within an extension cable as illustrated by FIG. 1 and the socket-outlet 10 is in a disconnection position, the sockets can undergo a certain torsion stress by way of the electrical cables to which they are connected. These stresses could cause the socket-outlet to be brought into the socketing configuration, such that the socket-outlet 10 could become un-socketed from the plug 50, which is not desirable. Thus, the resistance offered by the first tooth 18E1 makes it possible to avoid this risk.

It should be noted that in general, the retaining device 24 makes it possible to retain the shaft 18 in three predetermined angular positions. Thus, when the needle 26A is between the stop 19A and the tooth 18E1, the shaft is retained in a first predetermined angular position where the disc 22 is in the protection position and the shutter 34 in the closing position, the shutter 34 being rotationally blocked between the disc 22 and the cage 28. Owing to the retaining device 24, the disc 22, rotationally coupled with the shaft 18, is retained in the protection position, and the shutter 34 is rotationally blocked between the cage 28 which is fixed and the disc 22 which is retained by the retaining device 24, such that the shutter 34 is also retained in the closing position. In the same way when the needle 26A is between the stop 19B and the tooth 18E2, the shaft is retained in a second predetermined angular position where the disc 22 is in the connection position and the shutter 34 in the open position, the shutter 34 being rotationally blocked between the disc 22 and the cage 28. Owing to the retaining device 24, the disc 22, rotationally coupled to the shaft 18, is retained in the connection position, and the shutter 34 is rotationally blocked between the cage 28 which is fixed and the disc 22 which is retained by the retaining device 24, such that the shutter 34 is also retained in the open position.

In general, it should be noted that the base 20 forms an immovable element of the socket-outlet 10. The base 20 receives on a first side the cable clamp 15B, as well as a central cable clamp 15C connected to a recessed central contact 15D configured to receive the end of the central pin 52. The pin 52 being connected to the earth, the central contact 15D is obviously also connected to the earth (i.e. ground contact). The base 20 receives on a second side, opposite along the axial direction X to the first side, the displacement mechanism 16 and the device 24 for retaining in position. This second side of the base 20 also receives a cage 28 housing the movable element 14 and serving as a bearing for the disc 22. The contact elements 15A are disposed outside the cage 28. This entire assembly is received in the casing 12, the base 20 being blocked within the casing 12 by a bush 30 and immovable within the casing 12. In other words, the base 20 is coupled with the casing 12.

The plug 50 comprises a central pin 52 which forms an actuator configured to actuate the displacement mechanism 16 of the movable element 14 of the socket-outlet 10. In this example, the central pin 52 is formed by a stem extending axially. More precisely, the central pin 52 has a square section, one corner of which has a flat 52A forming a failsafe part. This pin 52 is configured to engage in the recess 18C of the shaft 18 and cooperates by interlocking with the walls of this recess 18C and of the central hole 22B of the disc 22. In other words, in this example, the central pin 52 forms a complementary element configured to cooperate by interlocking with the shaft 18 and the disc 22. Thus, when the socket-outlet 10 is in engagement with the plug 50, the pin 52 is socketed into the shaft 18 and rotationally coupled with the shaft 18. Thus, when the socket-outlet 10 and the plug 50 are turned with respect to one another about the axis X, the pin 52 drives the shaft 18 in rotation, owing to which the displacement mechanism 16 of the movable element 14 is actuated.

The different phases of use of the socket-outlet 10 and of the plug 50 will now be described with reference to FIGS. 5A to 8D. For clarity of disclosure, the wires of the cables shown in FIG. 1 are not shown. It should be noted that the radii in broken lines in FIGS. 5C, 6C, 7C and 8C indicate the angular stroke travelled by the disc 22 and the shutter 34.

In FIGS. 5A to 5D, the socket-outlet 10 and the plug 50 are separated and brought near to one another along the axial direction X. The socket-outlet 10 is in the socketing configuration, the movable element 14 being in the isolated position and the needle 26A of the two plunger elements 26 disposed between the stop 19A and the first tooth 18E1. The bold arrow (not referenced) indicates the movement of engagement of the socket-outlet 10 and the plug 50. As indicated above, to socket the plug 50 to the socket-outlet 10, the index 56A is aligned with the indicator 12A as is shown in FIG. 5A. Of course, the socket-outlet 10 and the plug 50 are configured in such a way that when the index 56A and the indicator 12A are aligned, the pegs 56B are aligned with the entrances of the channels 12D, and the failsafe part 52A of the pin 52 is aligned with the failsafe part 18C1 of the displacement mechanism 26 and the failsafe part 22B1 of the disc 22. The holes 22C of the disc of 22 are also aligned with the peripheral pins 54.

Thus, by socketing the socket-outlet 10 and the plug 50 in this way, they are put in engagement. It should be noted that in general, within the meaning of the present disclosure, it is considered that the sockets are in engagement when the actuator of the plug and displacement mechanism of the socket-outlet cooperate in such a way as to be able to actuate the displacement mechanism (i.e. in the present example, the pin 52 is inserted into the shaft 18). Thus, it will be understood that the pegs 56B and the channels 12D are optional.

In this configuration, the disc 22 is in the protection position whereas the shutter 34 is in the closing position (see FIG. 5C). The first lug 34C is abutting in the second circumferential direction C2 against the second shoulder 22D2 whereas the second lug 28B1 is abutting in the first circumferential direction C1 against the fourth shoulder 34D2 (see FIG. 5D). As indicated above, owing to the device 24 for retaining in position, the disc 22 and the shutter 34 are retained in their respective positions, such that the shutter is blocked between the disc 22 and the cage 28.

In FIGS. 6A to 6D, the socket-outlet 10 and the plug 50 are in engagement. The pin 52 extends through the hole 22B and is socketed into the recess 18C of the shaft 18 and in the central hole 22B of the disc 22. The pins 54 extend through the holes 22C of the disc 22. The socket-outlet 10 is in a socketing configuration, the movable element 14 being in the isolated position and the needle 26A of the two plunger elements 26 disposed between the stop 19A and the first tooth 18E1. The central pin 52 is in electrical contact with the central contact 15D whereas the mobile element 14 is distant from the peripheral pins 54 and from the contact elements 15A. The positions of the disc 22 and of the shutter 34 remain unchanged (see FIGS. 6C and 6D, respectively identical to the FIGS. 5C and 5D).

By turning the socket-outlet 10 and the plug 50 with respect to one another about the axis X, in such a way as to bring the index 56A onto the indicator 12B (see bold arrow not referenced in FIG. 6A), the socket-outlet 10 is brought into the disconnected configuration (i.e. electrically disconnected) shown in FIGS. 7A to 7D. The pin 52 has driven the shaft 18 in rotation about the axis X, such that the needle 26A of the two plunger elements 26 is disposed between the first tooth 18E1 and the second tooth 18E2. The lug 14C is at the foot of the inclined portion 18A2 of the spiral groove 18A. The movable element 14 is therefore still in the isolated position and remains distant from the peripheral pins 54 and from the contact elements 15A. The central pin 52 is always in electrical contact with the central contact 15D. Moreover, the peripheral pins 54 and the disc 22 have followed the rotation movement. Thus, the pins 14 are brought closer together along the circumferential direction of their respective pads 14B4 but are still not aligned along the axial direction with the pads 14B4.

During this movement, the second shoulder 22D2 of the disc 22 has released the first lug 34C along the first circumferential direction C2 whereas the first shoulder 22D1 of the disc 22 is not yet abutting in the second circumferential direction C2 against the first lug 34C (see FIG. 5C). Thus, the disc 22 and the shutter 34 are not rotationally coupled. It should be noted that the fourth shoulder 34D2 of the shutter 34 is still abutting against the second lug 28B1 of the cage 28. The shutter 34 can therefore correctly turn along the second circumferential direction C2. The shutter 34 has passed, in relation to the disc 22, from the closing position to an intermediate position between the closing position and the open position whereas the disc 22 has passed into an intermediate position between the protection position and the connection position (see FIG. 7D). However, only the disc 22 has turned whereas the shutter 34 has remained immovable with respect to the cage 28.

By turning the socket-outlet 10 and the plug 50 with respect to one another about the axis X, in such a way as to bring the index 56A onto the indicator 12C (see bold arrow not referenced in FIG. 7A), the socket-outlet 10 is brought into the connected configuration (i.e. electrically connected) shown in FIGS. 8A to 8D. The pin 52 has driven the shaft 18 in rotation about the axis X, such that the needle 26A of the two plunger elements 26 is disposed between the second tooth 18E2 and the stop 19B. The lug 14C has been driven along the direction X by the inclined portion 18A2 of the spiral groove 18A, such that the movable element 14 has passed from the isolated position to the contact position. The pads 14B4 are in contact with the pins 54 which, owing to this last rotation, are aligned along the axial direction with the pads 14B4. In addition, the pads 14B3 are in contact with the contact elements 15A. As the supports 14B1 are conductors of electrical current, the pins 54 are thus in contact with the active parts of the socket-outlet 10. It should be noted that the springs 14B2 supporting the supports 14B1 are compressed and thus exert a some pressure along the axial direction on the pins 54 and the contact elements 15A, via the pads 14B3 and 14B4.

Owing to the displacement mechanism 16 of the movable element 22 and the device 24 for retaining in position of the mobile element 22, contact between the active parts of the socket-outlet 10 and the pins 54 of the plug 50 is perfectly controlled and independent of the speed of socketing of the two sockets. In this example, the contact is made upon passing from the disconnection configuration to the connection configuration of the socket-outlet 10. The axial distance separating the pads 14B4 from the pins 54 in the isolated position is at least 6 mm. Thus, the risk of formation of electrical arcs upon connection is avoided, or at least minimal.

Figure 8D:
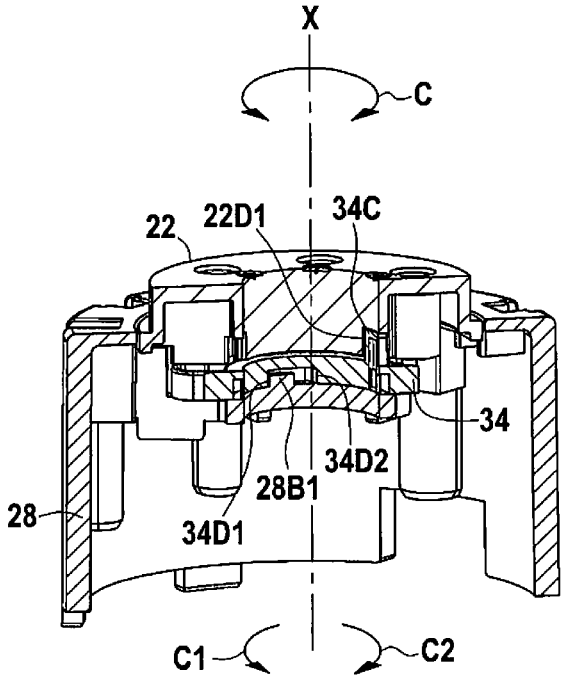

During the movement of rotation described above, the first shoulder 22D1 of the disc 22 comes into abutment against and drives the first lug 34C, and therefore the shutter 34, along the second circumferential direction C2 whereas the third shoulder 34D1 of the shutter 34 abuts against the second lug 28B1 (i.e. the second lug 28B1 is abutting along the first circumferential direction C1 against the third shoulder 34D1). Thus, the shutter 34 has passed into the open position and is rotationally blocked between the disc 22 and the cage 28. The disc 22 has passed into the connection position. Both the disc 22 and the shutter 34 have turned with respect to the cage 28. From the initial state shown in FIGS. 5C and 6C, the disc 22 has travelled an angular stroke $\alpha 3$ whereas the shutter has travelled an angular stroke $\alpha 1$, less than $\alpha 3$. As described above, the retaining device 24 retains the disc 22 and the shutter 34 in these positions. In FIG. 8D, although the contacts are not shown for the clarity of the figure, the holes 22C being aligned with the contacts 14B4, the position of the holes 22C therefore corresponds to the position of the contacts. Thus, considered along the circumferential direction, when the movable element 14 is in the contact position, each contact is disposed between two adjacent branches of the star shape of the shutter 34.

Of course, to bring the socket-outlet 10 into the disconnected configuration, then into the socketing configuration, and finally to unsocket the two sockets from one another, the relative movements are effected between the two sockets opposite those described above with reference to FIGS. 5A to 8D.

Although the present invention has been described with reference to specific embodiments, it is obvious that modifications and changes can be made to these examples without departing from the general scope of the invention as defined by the claims. In particular, individual features of the different embodiments illustrated/mentioned can be combined in additional embodiments. Consequently, the description and the drawings must be considered as illustrative rather than restrictive.

For example, according to a variant, the socket-outlet does not comprise any movable element, but a solid isolating body having recesses configured to each receive one pin of the plug. The disc can be mounted on this isolating body and the shutter between the isolating body and the disc. The isolating body or a casing forms the fixed element. The disc can then be driven in rotation directly by the central pin of the plug.

According to another example, any element immovable with respect to the disc and to the shutter can form a fixed element within the meaning of the present disclosure.

The invention claimed is:

1. A socket-outlet extending along an axial direction and along a circumferential direction, the socket-outlet comprising:

a fixed element;

a disc having through-holes for passing pins of a plug in order to electrically connect the plug to contacts of the socket-outlet, the disc being rotationally movable about the axial direction with respect to the fixed element between a protection position, wherein the holes are not aligned along the axial direction with the corresponding contacts, and a connection position, wherein each hole is aligned along the axial direction with a corresponding contact; and a shutter rotationally movable about the axial direction with respect to the fixed element and with respect to the disc between a closing position, wherein the shutter closes at least one hole of the disc when the disc is in the protection position, and an open position, wherein the shutter opens up the at least one hole when the disc is in the connection position.

2. The socket-outlet as claimed in claim 1, wherein an angular stroke of the shutter between the closing position and the open position is less than an angular stroke of the disc between the protection position and the connection position.

3. The socket-outlet as claimed in claim 1, wherein the disk is rotationally coupled with the shutter over a predetermined angular stroke less than a total angular stroke of the disc between the protection position and the connection position.

4. The socket-outlet as claimed in claim 3, wherein one element from among the shutter and the disc has a first lug configured to abut along the circumferential direction in a first direction against a first shoulder of the other element from among the shutter and the disc and in a second direction, opposite the first direction, against a second shoulder of the other element from among the shutter and the disc, the difference between the total angular stroke of the disc between the protection position and the connection position and the predetermined angular stroke being equal to the maximum angular stroke of the first lug between the first shoulder and the second shoulder.

5. The socket-outlet as claimed in claim 3, wherein one element from among the shutter and the fixed element has a second lug configured to abut along the circumferential direction in a first direction against a third shoulder of the other element from among the shutter and the fixed element and in a second direction, opposite the first direction, against a fourth shoulder of the other element from among the shutter and the fixed element, the predetermined angular stroke being equal to the maximum angular stroke of the second lug between the third shoulder and the fourth shoulder.

6. The socket-outlet as claimed in claim 1, wherein the shutter is rotationally blocked between the fixed element and the disc when the disc is in the protection position.

7. The socket-outlet as claimed in claim 1, wherein the shutter is rotationally blocked between the fixed element and the disc when the disc is in the connection position.

8. The socket-outlet as claimed in claim 1, wherein the disc and the shutter are adjacent, the disc having an outer face, oriented toward the outside of the socket-outlet, and an inner face, oriented toward the inside of the socket-outlet and opposite along the axial direction to the outer face, the shutter being disposed on the side of the inner face of the disc with respect to the disc.

9. The socket-outlet as claimed in claim 1, wherein the shutter has a general star shape comprising a central part and a plurality of branches extending radially from the central part, at least one branch of the star being configured to close at least one hole of the disc when the shutter is in the closing position and when the disc is in the protection position.

10. The socket-outlet as claimed in claim 1, comprising a movable element bearing several contacts, the movable element being movable axially between a first position and a second position, the movable element being nearer to the disc along the axial direction in the first position than in the second position.

11. The socket-outlet as claimed in claim 9, wherein the contacts borne by the movable element are spaced apart along the circumferential direction and, considered along the circumferential direction, when the movable element is in the first position, each contact is disposed between two adjacent branches of the star shape of the shutter.

* * * * *